US007699498B2

(12) United States Patent
Zheng

(10) Patent No.: US 7,699,498 B2
(45) Date of Patent: Apr. 20, 2010

(54) LED LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipet Hsien (TW)

( * ) Notice: Subject to any disclaimer, the term of this patent is extended or adjusted under 35 U.S.C. 154(b) by 0 days.

(21) Appl. No.: 12/417,660

(22) Filed: Apr. 3, 2009

(65) Prior Publication Data

US 2010/0073932 A1 Mar. 25, 2010

(30) Foreign Application Priority Data

Sep. 25, 2008 (CN) ..... 2008 1 0304667

(51) Int. Cl.
*F21V 29/00* (2006.01)

(52) U.S. Cl. ..... 362/249.02; 362/800; 362/225; 362/373; 362/294

(58) Field of Classification Search ..... 362/800, 362/249.02, 545, 555, 217–225, 217.1–217.17, 362/547, 373, 294
See application file for complete search history.

(56) References Cited

U.S. PATENT DOCUMENTS

| | | | | |
|---|---|---|---|---|
| 7,237,936 | B1 * | 7/2007 | Gibson | 362/547 |
| 7,513,639 | B2 * | 4/2009 | Wang | 362/218 |
| 2008/0043479 | A1 * | 2/2008 | Wang | 362/373 |
| 2009/0116233 | A1 * | 5/2009 | Zheng et al. | 362/234 |
| 2009/0257226 | A1 * | 10/2009 | Liu et al. | 362/249.02 |
| 2009/0268477 | A1 * | 10/2009 | Zheng et al. | 362/373 |

* cited by examiner

*Primary Examiner*—Laura Tso
(74) *Attorney, Agent, or Firm*—Frank R. Niranjan

(57) ABSTRACT

An LED lamp includes a bracket and a heat sink secured to the bracket. The heat sink has a base and a plurality of mounting members and platforms extending upwardly from the base. A plurality of LED modules are mounted on the mounting members and the platforms. A pair of LED modules located beside and adjacent to a central line of the base is disposed slantwise and face inwardly to each other. Another pair of LED modules at two opposite lateral portions of the base of the heat sink is disposed slantwise and face outwards. The LED modules mounted on the platforms face upwardly.

15 Claims, 5 Drawing Sheets

LED LAMP

BACKGROUND

1. Technical Field

The disclosure generally relates to LED (light emitting diode) lamps, and more particularly to an LED lamp having a large illumination angle.

2. Description of Related Art

An LED lamp is a type of solid-state lighting that utilizes LEDs as a source of illumination. The LED lamp is intended to be a cost-effective yet high quality replacement for incandescent and fluorescent lamp due to its long-term reliability, environment friendliness, and low power consumption.

A conventional LED lamp comprises a heat sink and a plurality of LED modules having LEDs attached to an outer surface of the heat sink dissipating heat generated by the LEDs. The outer surface is generally planar. When the LED lamp works, the LEDs on the planar outer surface of the heat sink only form a planar light source.

What is needed, therefore, is an LED lamp having a large illumination angle to thereby function as a three-dimensional light source.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
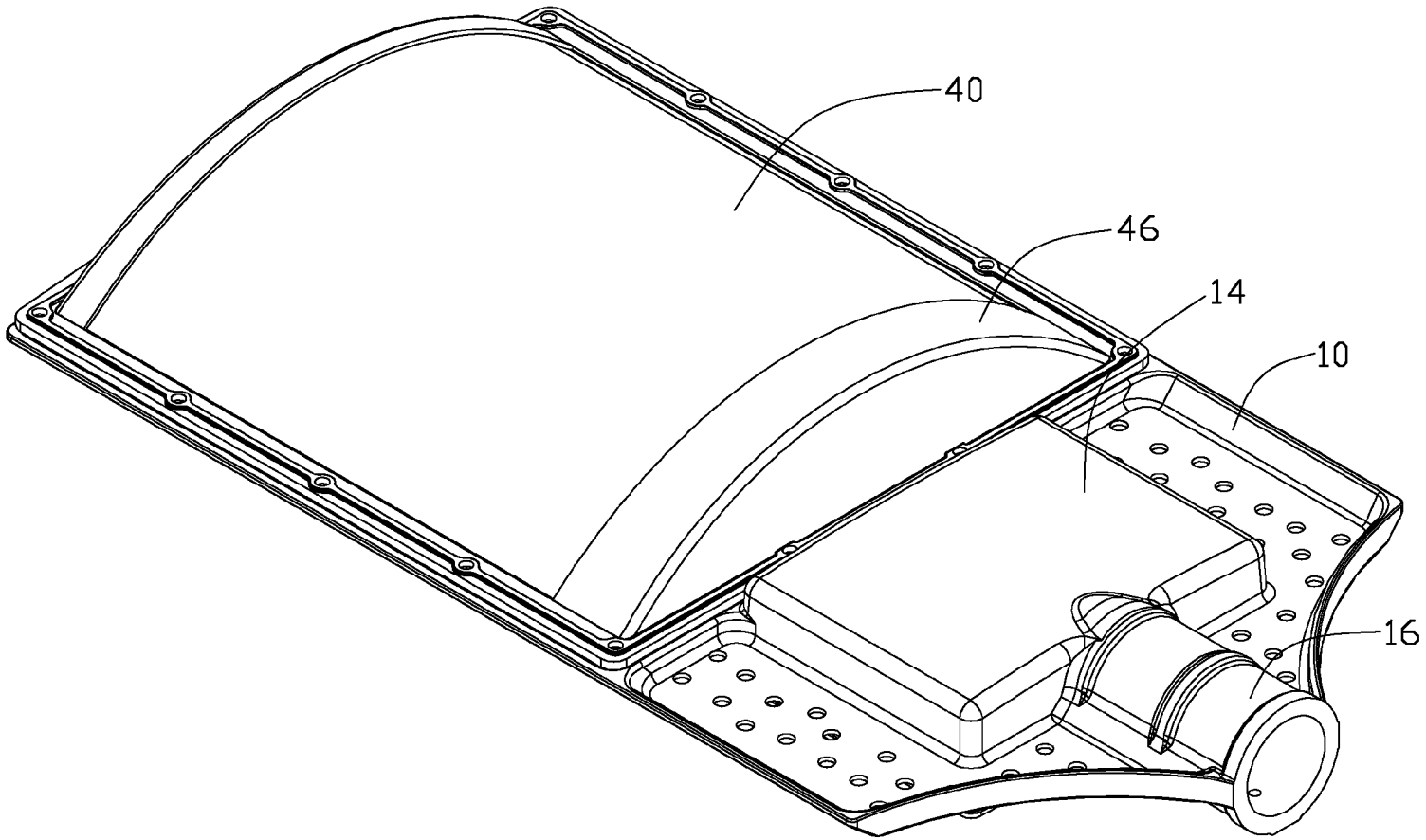
FIG. 1 is an assembled, isometric view of an LED lamp in accordance with a first embodiment of the disclosure.
Figure 2:
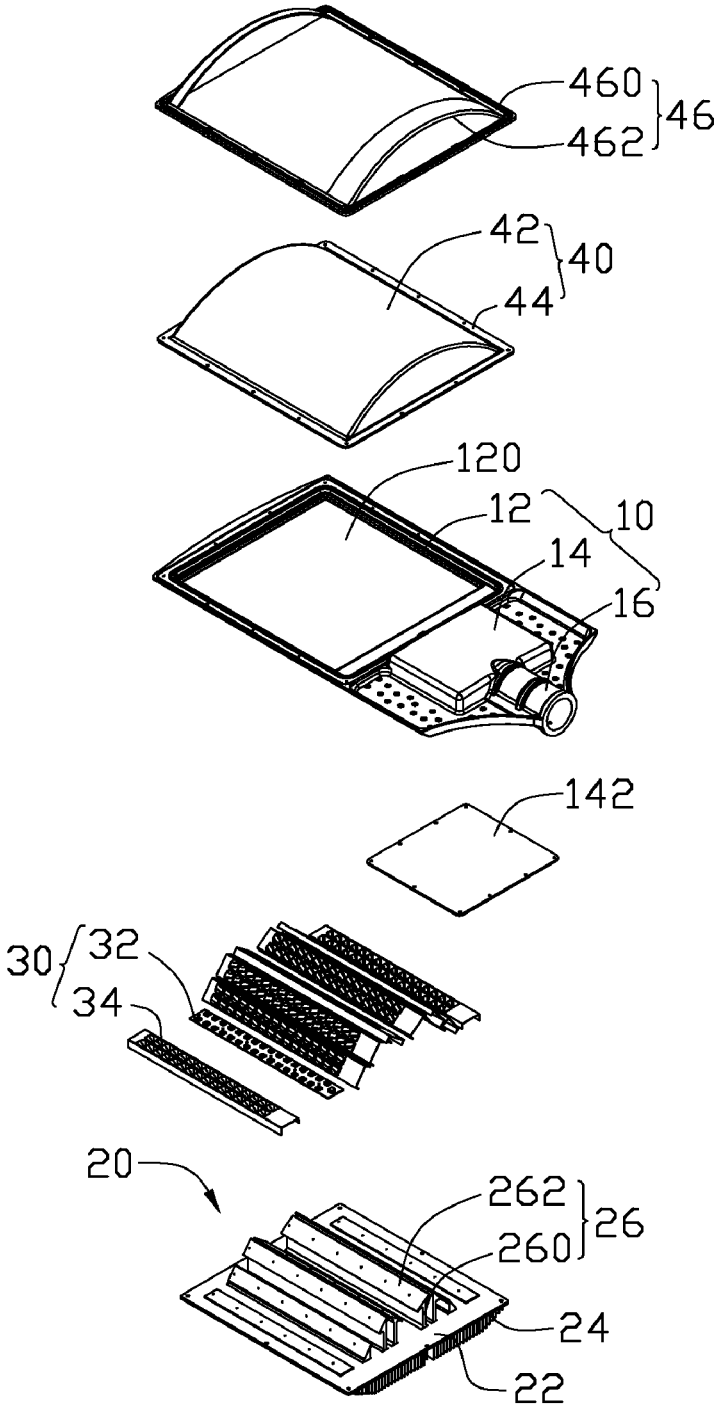
FIG. 2 is an exploded view of the LED lamp of FIG. 1.

Referring to FIGS. 1-2, an LED lamp in accordance with a first embodiment of the disclosure having a substantially rectangular configuration comprises a bracket 10, a heat sink 20 on a bottom of the bracket 10, a plurality of light source modules 30 on a top of the heat sink 20, and a transparent envelope 40 on a top of the bracket 10 covering the light source modules 30.

Figure 3:
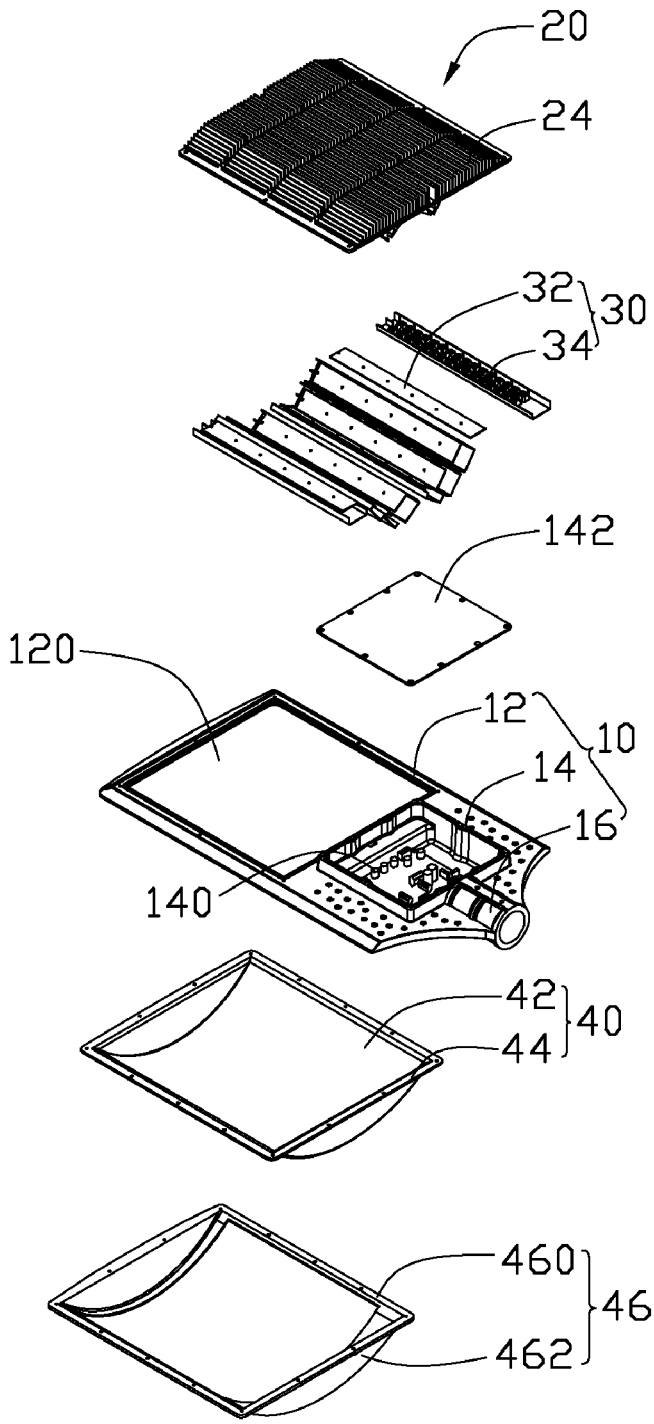
FIG. 3 is an inverted view of FIG. 2.

Referring also to FIG. 3, the bracket 10, integrally formed as a single piece, comprises a fixing frame 12, a driving circuit module 14 located at an end of the fixing frame 12 and a lamp holder 16 extending horizontally and outwardly from a center portion of an end of the driving circuit module 14. The fixing frame 12 is substantially rectangular and has a rectangular opening 120 defined in a center thereof. The heat sink 20 is mounted on a bottom of the fixing frame 12 and partially extends upwardly through the rectangular opening 120 of the fixing frame 12. The transparent envelope 40 is mounted on a top of the fixing frame 12 and cooperates with the heat sink 20 to form a receiving space (not shown) therebetween. The light source modules 30 are received in the receiving space. A driving circuit board 140 is received in the driving circuit module 14 and connected electronically with the light source modules 30. A cover 142 is attached to the driving circuit module 14 and covers the driving circuit board 140 in the driving circuit module 14. The lamp holder 16 connects the LED lamp to a supporting structure, such as a post (not shown).

Figure 4:
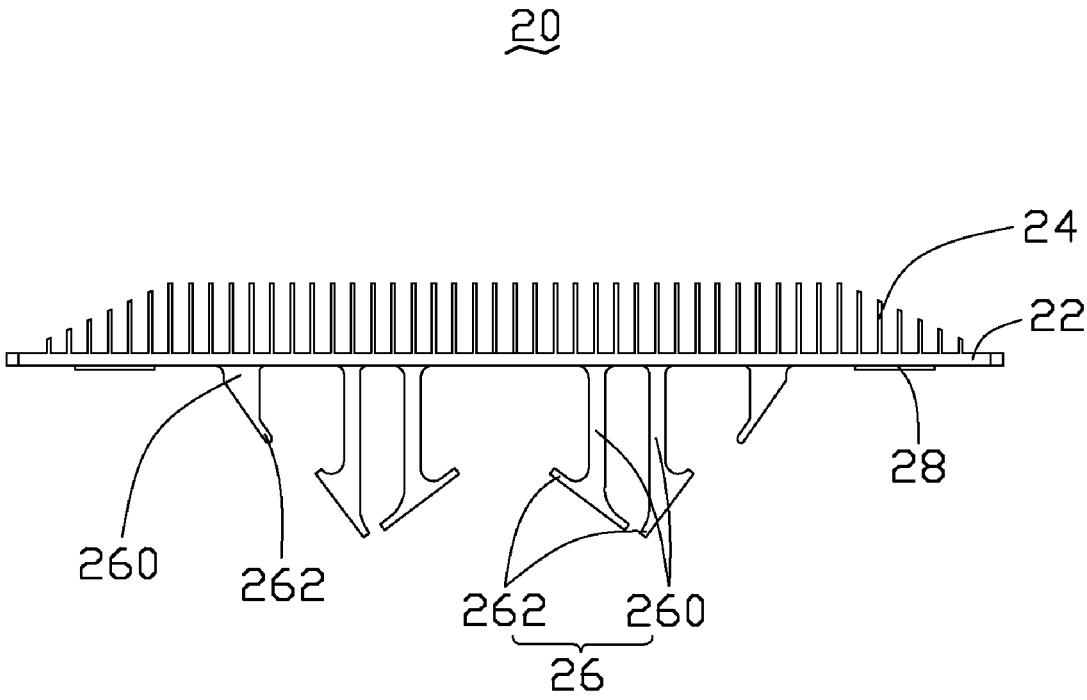
FIG. 4 is a cross-sectional view of a heat sink of the LED lamp of FIG. 2.

Referring also to FIG. 4, the heat sink 20, integrally formed of materials having high thermal conductivity, comprises a rectangular base 22, a plurality of spaced parallel fins 24 extending downwardly from a bottom face of the base 22, a set of mounting members 26 extending upwardly from a top face (not labeled) of the base 22 and two platforms 28 located at two opposite sides of the set of mounting members 26. The base 22 covers the rectangular opening 120 of the bracket 10, thereby abutting the top face thereof to the bracket 10 near a peripheral edge of the rectangular opening 120, and the set of mounting members 26 extend upwardly through the rectangular opening 120. A plurality of fasteners (not shown) extends through the fixing frame 12 to threadedly engage with a peripheral portion of the base 22, thereby mounting the heat sink 20 on the fixing frame 12 of the bracket 10.

The set of mounting members 26 is symmetrical about a longitudinal central line (not shown) of the top face of the base 22. The mounting members 26 are parallel and spaced from each other. Each mounting member 26 comprises a rectangular extending plate 260 extending upwardly and perpendicularly from the top face of the base 22 and a rectangular mounting plate 262 extending slantwise from a top end of the extending plate 260. The light source modules 30 are on top faces of the mounting plates 262 and the platforms 28, respectively. The mounting members 26 are of the same length and parallel to each fin 24 of the heat sink 20.

Heights of the extending plates 260 gradually decreases from a central portion of the base 22 to two opposite lateral sides. The extending plates 260 are parallel to the longitudinal central line of the top face of the base 22, wherein two pairs of the extending plates 260 adjacent to the central line have the same height as each other, which are larger than that of other extending plates 260 which are located remotely from the central line of the base 22 and between the platforms 28 and the two pairs of the extending plates 260 adjacent to the central line. The platforms 28 project from the top face of the heat sink 20, and parallel to the longitudinal central line of the top face of the base 22. The platforms 28 are shorter than all of the mounting members 26.

A pair of mounting plates 262 at the central portion of the base 22 incline inwardly and substantially face toward each other, so that extending lines (not shown) of the pair of mounting plates 262 intersect below the pair of mounting plates 262, whereby light emitted from the light source modules 30 on the pair of mounting plates 262 intersects between the pair of mounting plates 262 at a place above the mounting plates 262 and just above the central portion of the base 22 of the heat sink 20. The light further projects toward a place above the two opposite lateral sides of the base 22. Each of the other mounting plates 262 inclines outwardly. A line connecting the mounting plates 262 forms generally an inverted W-shaped profile. Two corresponding mounting plates 262 besides the central ones are substantially opposite to each other. Extending lines (not shown) of the corresponding mounting plates 262 intersect at a place above the two corresponding mounting plates 262, whereby light emitted from the light source modules 30 on the corresponding mounting plates 262 radiates toward the place above the two opposite lateral sides of the base 22. The two mounting plates 262 of the other two mounting members 26 beside the two pairs of central mounting members 26 face upwardly and outwardly, whereby the light emitted from the light source modules 30 mounted thereon radiates also toward the two opposite lateral sides of the base 22. Thus, light emitted from the light source modules 30 on the mounting plates 262 is radiated from the central portion of the base 22 toward the two opposite lateral sides thereof to increase the illumination angle of the LED lamp. The light source modules 30 mounted on the platforms 28 radiate directly upwardly.

Referring to FIGS. 2-3 again, each light source module 30 comprises a rectangular LED module 32, and a reflector 34 mounted on the LED module 32.

The transparent envelope 40 comprises a transparent barrel vault 42 and a mounting portion 44 extending outwardly from a peripheral edge of the transparent barrel vault 42. The transparent barrel vault 42 corresponds to the light source modules 30. The mounting portion 44 contacts the fixing frame 12 and surrounds the rectangular opening 120 of the fixing frame 12 of the bracket 10. A lid 46 covers the transparent envelope 40, mounting the transparent envelope 40 on the fixing frame 12 of the bracket 10. The lid 46 comprises two vaulted portions 462 located at two opposite ends thereof and an annular strip 460 enclosing the two vaulted portions 462. The annular strip 460 abuts the mounting portion 44 of the envelope 40. The vaulted portion 462 has the same profile as a corresponding end of the transparent barrel vault 42.

In assembly of the LED lamp, the top face of the base 22 abuts the peripheral edge of the rectangular opening 120 of the fixing frame 12 of the bracket 10, and the fasteners mounts the heat sink 20 on the fixing frame 12. At the same time, the mounting members 26 extend upwardly through the opening 120 of the fixing frame 12. The light source modules 30 are mounted on the mounting plates 262 of the mounting members 26. The mounting portion 44 of the envelope 40 contacts the peripheral edge of the opening 120 of the fixing frame 12, and the lid 46 covers the envelope 40, mounting the envelope 40 on the fixing frame 12 of the bracket 10.

Figure 5:
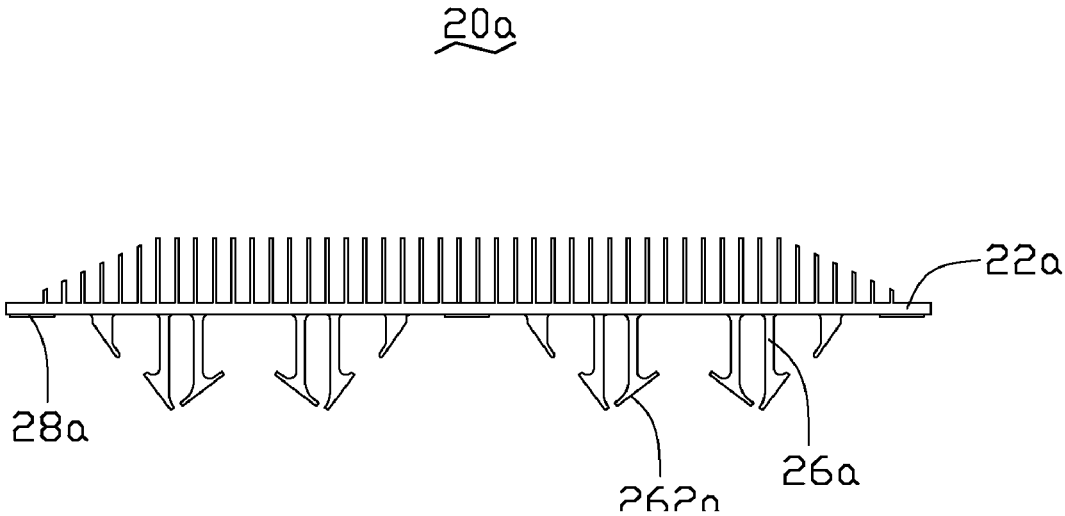
FIG. 5 is a cross-sectional view of a heat sink of an LED lamp in accordance with a second embodiment of the disclosure.

Referring to FIG. 5, a heat sink 20*a* of the LED lamp in accordance with a second embodiment of the disclosure is similar to the heat sink 20 of the first embodiment. The heat sink 20*a* comprises a base 22*a* and two sets of mounting members 26*a*. The two sets of mounting members 26*a* are disposed in succession according to quantity of the light source modules 30 or width of the base 22*a*, whereby a line connecting the mounting members 26*a* forms a wavy profile constituted of two generally inverted Ws. The sets of the mounting members 26*a* are symmetrical about a longitudinal central line (not shown) of the base 22*a*. Three platforms 28*a* are protruded from the base 22*a* and alternate with the two sets of mounting members 26*a*. A middle one of the platforms 28*a* coincides with the central line of the base 22*a*.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED lamp comprising:

a bracket; and a heat sink secured to the bracket, the heat sink having a base and a plurality of mounting members and platforms extending upwardly from the base;

a plurality of LED modules mounted on the mounting members and the platforms;

wherein a pair of LED modules mounted on the mounting members and located beside and adjacent to a central line of the base is disposed slantwise and inwardly so that light emitted from the pair of LED modules intersects at a place above the central line of the base of the heat sink and further projects toward places above two opposite lateral sides of the base of the heat sink, another pair of LED modules mounted on the mounting members and located beside the pair of LED modules is disposed slantwise and outwards so that light emitted from the another pair of LED modules projects directly toward places above the two opposite lateral sides of the base of the heat sink, and the LED modules mounted on the platforms face upwardly so that light emitted from the LED modules projects directly upwardly away from the base of the heat sink.

2. The LED lamp as claimed in claim 1, wherein each of the mounting members comprises an extending plate and a mounting plate on a top end of the extending plate, a corresponding LED module being attached to the mounting plate.

3. The LED lamp as claimed in claim 2, wherein a line connecting the mounting plates of the mounting members forms a generally inverted W-shaped profile.

4. The LED lamp as claimed in claim 2, wherein a line connecting the mounting plates of the mounting members forms a wavy profile constituted of a plurality of generally inverted Ws.

5. The LED lamp as claimed in claim 1, wherein the mounting members have the same length as each other.

6. The LED lamp as claimed in claim 1, wherein the mounting members are symmetrical about the central line of the base and spaced from each other.

7. The LED lamp as claimed in claim 2, wherein heights of the extending plates gradually decrease from the central line of the base toward the two opposite lateral sides of the base.

8. The LED lamp as claimed in claim 7, wherein two pairs of the extending plates adjacent to the central line of the base have the same height as each other and are larger than that of other extending plates located remotely from the central line of the base.

9. The LED lamp as claimed in claim 1, wherein the heat sink further comprises a plurality of fins extending downwardly from a bottom face of the base thereof, and the mounting members are parallel to the fins of the heat sink.

10. The LED lamp as claimed in claim 9, wherein the fins are spaced from and parallel to each other.

11. The LED lamp as claimed in claim 1, wherein the platforms are located at the two lateral sides of the base of the heat sink and the mounting members are located between the platforms.

12. The LED lamp as claimed in claim 1, wherein the mounting members are divided into a plurality of sets and the platforms are alternate with the sets of the mounting members.

13. An LED lamp comprising:

a bracket;

a heat sink mounted on a bottom of the bracket, the heat sink comprising a base and a set of mounting members extending upwardly from a top face of the base, each of the mounting members comprising an extending plate formed on top face of the base and a mounting plate extending slantwise from a top end of the extending plate, two central mounting plates of the set of mounting members are disposed inwardly to face each other, and the other mounting plates of the set of mounting members are disposed outwardly; and a plurality of LED modules mounted on top faces of the mounting plates of the set of mounting members of the heat sink, respectively.

14. The LED lamp as claimed in claim 13, wherein the extending plates of the set of mounting members of the heat sink are parallel.

15. The LED lamp as claimed in claim 14, wherein heights of extending plates of the set of mounting members corresponding to the other mounting plates of the set of mounting members gradually decreases toward two opposite sides of the set of mounting members.

* * * * *